US005588221A

United States Patent [19]

Hoeltke et al.

[11] Patent Number: 5,588,221

[45] Date of Patent: Dec. 31, 1996

[54] DRIVE DRIVE SHAFT FOR A PAINT BRUSH AND ROLLER COVER CLEANING MACHINE

[75] Inventors: Larry Hoeltke, Alden; Roger Fischer, Lancaster, both of N.Y.

[73] Assignee: Shur-Line, Inc., Lancaster, N.Y.

[21] Appl. No.: 535,719

[22] Filed: Sep. 28, 1995

[51] Int. Cl.[6] ..... F26B 17/24

[52] U.S. Cl. ..... 34/58; 74/127

[58] Field of Search ..... 34/58, 312; 134/900; 74/127; 366/279, 306, 343

[56] References Cited

U.S. PATENT DOCUMENTS 1,839,944 1/1932 Barthels ..... 34/58

2,794,265 6/1957 Kruger ..... 34/58

*Primary Examiner*—John M. Sollecito
*Assistant Examiner*—Steve Gravini
*Attorney, Agent, or Firm*—Phillips, Lytle, Hitchcock, Blaine & Huber

[57] ABSTRACT

An improved drive shaft assembly (11) for a paint brush and roller cover cleaning machine (10) providing a blank clutch disk (40) having an opening (41) which does not substantially increase in size with use of the paint brush or roller cover cleaning machine. Because the opening does not wear with use, a flange (42) mounted to the lower marginal end portion of a drive rod (16) is less likely to be pulled past the blank clutch disk.

4 Claims, 1 Drawing Sheet

FIG. 1.
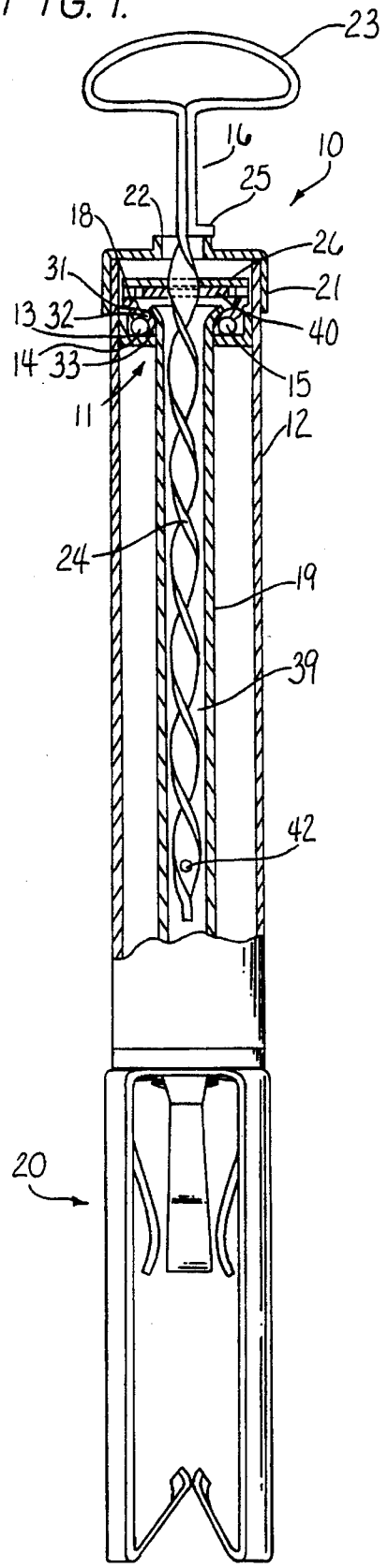
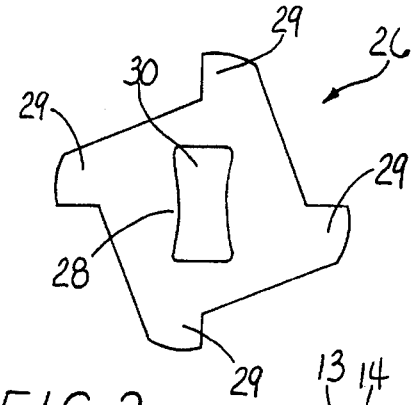
FIG. 2.
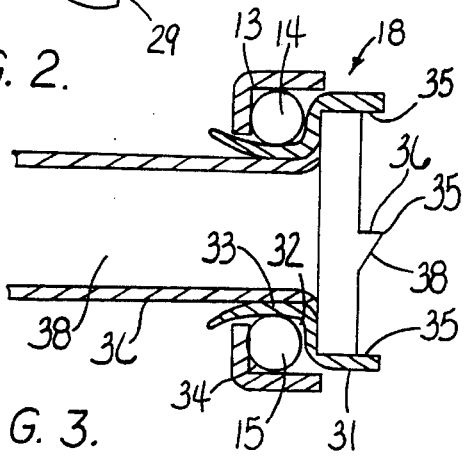
FIG. 3.
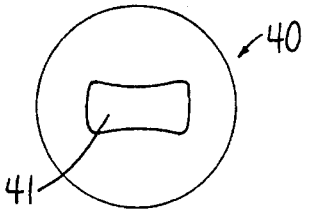
FIG. 4.
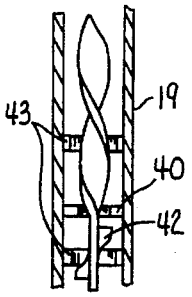
FIG. 5.
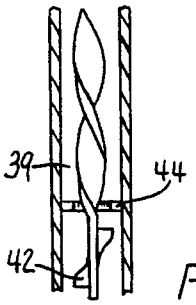
FIG. 6.

DRIVE DRIVE SHAFT FOR A PAINT BRUSH AND ROLLER COVER CLEANING MACHINE

TECHNICAL FIELD

This invention relates to known paint brush and roller cover cleaning machines and, more particularly, to a novel and unique drive shaft assembly for these cleaning machines.

BACKGROUND ART

The easy cleaning of paint brushes and roller covers saturated with paint has always presented a problem. One solution is to use a manually powered machine to spin the saturated brush or roller cover, thus using centrifugal forces to spin paint from the brush or roller cover. Machines operated on this principle first appeared in the mid 1950's and are described in U.S. Pat. Nos. 2,794,265 and 2,884,709 to M. M. Kruger and U.S. Pat. No. 2,912,769 to L. Kruger. The disclosures of the foregoing three patents are incorporated herein by reference.

In brief, these machines comprise a hollow canister within which a rotatable tubular shaft rests. Attached to the bottom of the tubular shaft beyond the canister is a paint applicator holding device configured to hold either a paint brush or a roller cover. The top of the canister is capped by a cover which has an opening therethrough. A drive rod proceeds through the opening in the cover and into the tubular shaft. The drive rod has a uniformly-twisted spiralling blade portion and a handle portion. At the distal end of the spiral portion is an outwardly-extending flange. A clutch disk member is mounted on the spiral portion of the drive rod above the top of the tubular shaft and below the canister cover. The clutch disk is able to freely slide on the spiral portion along an opening in the clutch disk through which the spiral portion passes. The clutch disk has a plurality of radi-ally-extending arms. The top of the tubular shaft connects to a wheel having upwardly-extending triangularly-shaped lugs.

As the drive rod is pushed into the canister, the spiral portion rotates the clutch disk. As the clutch disk rotates, the arms contact vertical faces of the triangularly-shaped lugs. This forces the wheel, the tubular shaft and the paint applicator holding device to rotate.

The upstroke of the drive rod rotates the clutch disk in the direction opposite its rotation during the downstroke. However, the clutch disk arms now contact a slopped face of the triangularly-shaped lugs and slide up and over without forcing counter rotation of the wheel, tubular shaft or paint applicator holding device. Thus, the spinning direction of the holding device is always in the same direction.

The upward stroke of the drive shaft is limited by the flange mounted to the twisted portion contacting the clutch disk member.

However, the drive rod is known to pull from the canister after use enlarges the opening in the clutch disk until the drive rod flange can pass. This can create a dangerous situation. Accordingly, it would be beneficial to provide a safer drive shaft having a drive rod less likely to be pulled from the canister during the upward stroke.

DISCLOSURE OF THE INVENTION

With parenthetical reference to the corresponding parts, portions or surfaces of the disclosed embodiment merely for purposes of illustration and not by way of limitation, the present invention provides an improved drive shaft assembly (11) to a paint brush and roller cover cleaning device (10). The drive shaft assembly comprises a drive rod (16), a wheel (18), a tubular shaft (19) and a paint applicator holding device (20). The wheel, tubular shaft and holding device are connected as a subassembly and mounted within canister (12) on balls (14 and 15) held by a cup (13). A cover (21), provided with a round opening (22) through which rod (16) will easily pass, caps the top of the canister. The lower portion of the rod is uniformly-twisted (24). A clutch disk (26) freely slides on the twisted portion below the cover and above the wheel. Immediately below the clutch disk is a blank clutch disk (40) which also freely slides on the twisted portion. Attached to the bottom of the tubular shaft is a paint application holding device configured to hold paint brush and a roller cover.

During the downward motion of the drive rod, the clutch disk engages lugs (35) extending upwardly from the wheel. The downward motion of the rod causes the rotation of the clutch disk, and thus the rotation of the wheel, the tubular shaft and the holding device. During the downward stroke of the rod, the blank clutch disk freely rotates about the rod in the opening defined among the lugs on the wheel.

During the upward stroke of the rod, both the clutch disk and the blank clutch disk rotate freely as neither engages another portion of the machine. The upward stroke of the rod comes to a stop when a flange (42) mounted to the distal end portion of the twisted portion of the drive rod engages the blank clutch disk. The engagement between the flange and the blank clutch disk prevents the rod from being pulled from the canister.

Accordingly, the general object of the invention is to provide an improved drive shaft for a paint brush and roller cover cleaning machine which reduces the probability of the drive rod being pulled from the canister during use.

Another object of the invention is to provide the improvement without substantial modification of the proven and easy to use design of paint brush and roller cover cleaning machines.

These and other objects and advantages will become apparent from the foregoing and ongoing written specification, the drawings and the appended claims.

BRIEF DESCRIPTION OF THE DRAWINGS

FIG. 1 is a partial vertical sectional view of a paint brush and roller cover cleaning machine incorporating the improved drive shaft.

FIG. 2 is a plan view of the clutch disk.

FIG. 3 is a fragmentary vertical sectional view of the wheel, ball and cup assembly and canister.

FIG. 4 is a plan view of the blank clutch disk.

FIG. 5 is a fragmentary vertical sectional view of the tubular shaft of the instant improvement incorporating an alternative blank clutch disk.

FIG. 6 is a fragmentary vertical sectional view of the tubular shaft of the instant improvement incorporating an alternative blank clutch disk.

MODES OF CARRYING OUT THE INVENTION

At the outset, it should be clearly understood that like reference numerals are intended to identify the same structural elements, portions or surfaces consistently throughout the several drawings figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As us ed in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

A paint brush and roller cover cleaning machine 10 is shown in FIG. 1 to comprise a drive shaft assembly 11 and a canister 12, in which a cup 13 is mounted. Cup 13 holds balls 14 and 15, which serve as bearings. Drive shaft 11 comprises drive rod 16, wheel 18, tubular shaft 19 and paint applicator holding device 20. At the upper end of canister 12 is a cover 21 provided with a round opening 22 through which a uniformly-twisted drive rod 16 will easily pass. Drive rod 16 is provided with a manual grip portion 23 for easy operation, i.e., drawn upward and pushed downward through cap 21, and a twisted portion 24. Drive rod 16 is also provided with a stop flange 25 to limit the downward movement of drive rod 16.

A clutch disk 26 freely slides on twisted portion 24 of drive rod 16 and is located directly under cover 21. As shown in FIG. 2, clutch disk 26 is provided with a body portion 28, four radially-projecting arms 29 and a central opening 30 through which drive rod 16 is freely movable. Opening 30 is substantially rectangular in shape, conforming closely, but not exactly to the cross-section of the twisted portion 24.

As shown in FIG. 3, wheel 18 comprises a base portion 31, shoulder portion 32 and neck portion 33. Balls 14 and 15 rest in race 34 defined by cup 13, shoulder 32 and neck 33. Extending upwardly from base 31 are four triangularly-shaped lugs 35, each having a vertical face 36 and a sloped face 38. Turning now to FIG. 1, tubular shaft 19, having an internal bore 39 adapted to receive twisted portion 24 of drive rod 16 in a sliding fit, is fixedly mounted to neck 33 of wheel 18. Paint applicator holding device 20 is fixedly mounted to the lower end of tubular shaft 19 (not shown).

Blank clutch disk 40, shown in FIG. 4, is approximately the size and shape of body portion 28 of clutch disk 26. Blank clutch disk 40 also has an opening 41 through which twisted portion 24 of drive rod 16 passes. Adverting to FIG. 2, blank clutch disk 40 freely slides on twisted portion 24 directly under clutch disk 26, and rests on shoulder 32 in the volume defined between lugs 35 of wheel 18.

In operation, the machine 10 is designed to centrifugally spin paint out of the bristles of a paint brush or paint roller which have been loosened by soaking and/or spinning in a suitable solvent or cleaning solution. As drive rod 16 is pushed downwardly, arms 29 engage vertical surface 36 of lugs 35. As twisted portion 24 of drive rod 16 is advanced, clutch disk 26 is rotated. This rotation applies force against lugs 35 and causes wheel 18 to rotate. Since the upper end of tubular shaft 19 is fixedly mounted to wheel 18, tubular shaft 19 also rotates. Thus, paint applicator holding device 20, which is fixedly mounted to the lower end of tubular shaft 19, is similarly forced to rotate. The downstroke of drive rod 16 comes to a halt when stop flange 25 meets cover 21 at opening 22.

Reversing the stroke, drive rod 16 is then drawn upward. This causes clutch disk 26 to spin in the direction opposite its rotation during the downward stroke. Arms 29 on the upward stroke contact slopped face 38 of lugs 35, and pass up and over the lugs. Thus, the rotation of tubular shaft 19 provided by the downstroke continues without stopping or reversing. The upstroke comes to a stop when flange 42, mounted at the lower marginal end portion of drive rod 16, meets blank clutch disk 40, which is drawn, along with clutch disk 26, to cover 21.

In prior art machines it was known for opening 30 of clutch disk 26 to widen through use over time from the force applied by the downstroke of drive rod 16. If this occurred, clutch disk 26 alone could not be relied upon to prevent drive rod 16 from being pulled from canister 12. The introduction of blank clutch disk 40 solves this problem. Blank clutch disk 40 does not translate the motion of drive rod 16 to the rotation of tubular shaft 19. Accordingly, very little stress, if any, is placed upon its opening 41. With no substantial forces acting upon opening 41, the likelihood of it deforming to allow flange 42 to pass through is greatly reduced.

Therefore, the invention provides a safer drive shaft for a paint brush and roller cover cleaning machine less likely to have the drive rod pulled from the canister.

MODIFICATION

The present invention contemplates that various changes and modifications may be made. For example, the invention contemplates the blank clutch disk could be positioned in a number of locations. One such alternate location is between two flanges, severally indicated at 43, fixedly mounted within tubular shaft 19 as shown in FIG. 5. In this embodiment, the upstroke of drive rod 16 would stop when flange 42 engages blank clutch disk 40 within tubular shaft 19.

Further, a blank clutch disk could be fixedly mounted to the interior of tubular shaft 19. In this embodiment, shown in FIG. 6, annular member 44 fixedly mounted within bore 39. The opening of the annular member 44 is large enough to allow drive rod 16 to pass, but small enough to stop flange 42 from passing.

Therefore, while the presently-preferred embodiment of the improved drive shaft has been shown and described and several modifications therein discussed, persons skilled in the art will appreciate that various additional changes and modifications may be made without departing from the spirit of the invention, as defined and differentiated by the following claims.

What is claimed is:

1. A drive shaft assembly for a manually operated paint brush and roller cover cleaning machine designed to free said brush and said roller cover of paint by centrifugal spinning, having a drive rod having a uniformly twisted spiralling blade portion and a flange extending radially from said blade portion, and having a clutch disk generated about an axis comprising a body portion having an opening through which said clutch disk axis passes and arms projecting radially from said clutch disk body portion, said blade portion passing through said clutch disk opening and said clutch disk freely slidable on said blade portion, and having a wheel, and having a tubular shaft, and having a paint applicator holding device, said wheel and said tubular shaft providing a continuous bore through which said blade portions passes, and said clutch disk operatively arranged to impart rotation to said wheel, said tubular shaft and said paint applicator holding device as said clutch disk is rotated by said blade portion passing through said clutch disk opening, said improvement comprising:

a blank clutch disk generated about an axis having an opening through which said blank clutch disk axis passes, and said blank clutch disk freely slidable on said blade portion, and said blank clutch disk located along said blade portion on the side of said clutch disk closer to said flange, and said blank clutch disk opening sized to allow passage of said blade portion but not said flange;

whereby said blank clutch disk prevents the unintentional removal of said drive rod from said drive shaft assembly by precluding passage of said flange beyond said clutch disk.

2. The improved drive shaft set forth in claim 1 wherein said blank clutch disk is located adjacent said clutch disk and said blank clutch disk is operatively arranged to rotate as said blade portion passes through said blank clutch disk opening.

3. The improved drive shaft set forth in claim 1 wherein said blank clutch disk is located between two annular flanges mounted to the interior wall of said tubular shaft, and said blank clutch disk is freely slidable on said blade portion, constrained only by said annular flanges, and said blank clutch disk is operatively arranged to rotate as said blade portion passes through said blank clutch disk opening.

4. The improved drive shaft set forth in claim 1 wherein said blank clutch disk has a maximum radius about said blank clutch disk axis not greater than the maximum radius of said clutch disk body portion about said clutch disk axis.

* * * * *

UNITED STATES PATENT AND TRADEMARK OFFICE

CERTIFICATE OF CORRECTION

PATENT NO. : 5,588,221
DATED : December 31, 1996
INVENTOR(S) : Larry Hoeltke, et. al.

It is certified that error appears in the above-indentified patent and that said Letters Patent is hereby corrected as shown below:

Title page, item [54] and col. 1, line 1, delete Drive(first occurrences).

Signed and Sealed this

Sixth Day of May, 1997

*Attest:*

Bruce Lehman

BRUCE LEHMAN

*Attesting Officer*

*Commissioner of Patents and Trademarks*